US007632170B2

(12) United States Patent
O'Moore et al.

(10) Patent No.: US 7,632,170 B2
(45) Date of Patent: Dec. 15, 2009

(54) CMP APPARATUSES WITH POLISHING ASSEMBLIES THAT PROVIDE FOR THE PASSIVE REMOVAL OF SLURRY

(75) Inventors: Fergal O'Moore, Los Gatos, CA (US); Steve Schultz, Gilbert, AZ (US); Brian Severson, Chandler, AZ (US)

(73) Assignee: Novellus Systems, Inc., San Jose, CA (US)

( * ) Notice: Subject to any disclaimer, the term of this patent is extended or adjusted under 35 U.S.C. 154(b) by 0 days.

(21) Appl. No.: 11/768,045

(22) Filed: Jun. 25, 2007

(65) Prior Publication Data

US 2008/0318495 A1 Dec. 25, 2008

(51) Int. Cl.
*B24B 7/04* (2006.01)
*B24B 11/00* (2006.01)

(52) U.S. Cl. ..... 451/65; 451/288; 451/446; 451/527; 451/533; 451/550

(58) Field of Classification Search ..... 451/36, 451/60, 65, 446, 527, 533, 550
See application file for complete search history.

(56) References Cited

U.S. PATENT DOCUMENTS

| | | | | |
|---|---|---|---|---|
| 5,658,185 | A * | 8/1997 | Morgan et al. | 451/36 |
| 5,876,271 | A | 3/1999 | Oliver | |
| 6,095,904 | A * | 8/2000 | Breivogel et al. | 451/41 |
| 6,572,445 | B2 * | 6/2003 | Laursen | 451/10 |
| 6,692,338 | B1 * | 2/2004 | Kirchner | 451/41 |
| 6,705,928 | B1 * | 3/2004 | Barns | 451/60 |
| 7,314,402 | B2 * | 1/2008 | Laursen et al. | 451/41 |

OTHER PUBLICATIONS

International Search Report for International Patent Application No. PCT/US2007/073249, mailed Apr. 11, 2008.

* cited by examiner

*Primary Examiner*—Timothy V Eley
(74) *Attorney, Agent, or Firm*—Ingrassia Fisher & Lorenz, P.C.

(57) ABSTRACT

Chemical mechanical planarization apparatuses with polishing assemblies that provide for the passive removal of slurry are provided. In accordance with an embodiment, a work piece polishing assembly comprises a polishing pad comprising a polishing surface and an exhaust aperture that extends through the polishing pad from the polishing surface and is configured to receive a slurry from the polishing surface. An underlying member is disposed underlying the polishing pad and comprises a peripheral surface. The underlying member comprises a channel that is in fluid communication with the aperture and that opens at the peripheral surface of the underlying member.

15 Claims, 4 Drawing Sheets

CMP APPARATUSES WITH POLISHING ASSEMBLIES THAT PROVIDE FOR THE PASSIVE REMOVAL OF SLURRY

FIELD OF THE INVENTION

The present invention relates generally to apparatuses for polishing a surface of a work piece. More particularly, the invention relates to chemical-mechanical planarization apparatuses with polishing assemblies that provide for the passive removal of slurry from a polishing surface.

BACKGROUND OF THE INVENTION

The manufacture of many types of work pieces requires the substantial planarization or polishing of at least one surface of the work piece. Examples of such work pieces that require a planar surface include semiconductor wafers, optical blanks, memory disks, and the like. One commonly used technique for planarizing the surface of a work piece is the chemical mechanical planarization (CMP) process. The terms "planarization" and "polishing," or other forms of these words, although having different connotations, are often used interchangeably by those of skill in the art with the intended meaning conveyed by the context in which the term is used. For ease of description such common usage will be followed and the term "chemical mechanical planarization" will generally be used herein with that term and "CMP" conveying either "chemical mechanical planarization" or "chemical mechanical polishing." The terms "planarize" and "polish" will also be used interchangeably.

The CMP method typically requires the work piece to be loaded into and mounted precisely on a carrier head in a manner such that the surface to be planarized is exposed. The exposed side of the work piece is then held against a polishing pad and relative motion is initiated between the work piece surface and the polishing pad in the presence of a polishing slurry. The mechanical abrasion of the surface caused by the relative motion of the work piece with respect to the polishing pad combined with the chemical interaction of the slurry with the material on the work piece surface ideally produces a planar surface.

The polishing slurry can be applied to the surface of the polishing pad by deposition of the slurry directly onto the polishing surface of the polishing pad or, alternatively, the slurry can be delivered from a manifold assembly underlying the polishing pad through supply apertures or "through-holes" within the polishing pad. Spent slurry, that is, slurry that has reacted with the work piece surface and contains by-products from the polishing process then is removed from the surface of the polishing pad so that it can be replaced by fresh slurry for uniform planarization.

As an alternative to traditional CMP, electrochemical mechanical planarization (ECMP) can be used for polishing the work piece. ECMP involves removal of material from the surface of the work piece through the action of an electrolyte solution, electricity, and relative motion between the work piece and the surface of the polishing pad. The ECMP slurry, or electrolyte, also needs to be removed from the surface of the polish pad as does traditional CMP slurry.

Various methods have been used to remove the spent slurry from the polishing pad. One method utilizes polishing pads having grooves within the surface of the polishing pad that permit the spent slurry to flow out from the center of the polishing pad to be exhausted from a peripheral edge of the pad. While wide grooves would permit the slurry to flow freely, the width of the grooves is limited because wider grooves result in less polishing pad available for contact with the work piece. Accordingly, with narrow grooves, the flow of the slurry may be restricted and the residence time of the spent slurry on the surface of the pad may be longer than desired. As a result, a pressure gradient forms across the polishing pad from the center to the peripheral edge. This slurry build-up also may cause the work piece to hydroplane on the polishing pad, decreasing the polishing rate. Moreover, as the polishing pad wears, the depth of the grooves becomes even smaller, thus further reducing the volume of slurry the grooves can carry and compounding the above problems.

Another method for removing slurry from the surface of a polishing pad includes exhaust ports that extend through the polishing pad and the underlying polishing assembly. The polishing assembly can include one or more polishing sub-pads, such as a backing pad, a platen that is configured to support the polishing pad, and a manifold assembly that distributes the slurry to the surface of the polishing pad. The exhaust ports may use the force of gravity to exhaust the slurry or may be connected to a pump that pumps the slurry from the polishing pad. Accordingly, the exhaust ports are configured to extend, not only through the polishing pad, but also any polishing sub-pads, the platen and the manifold assembly. Because the polishing sub-pads, platen, and manifold assembly are manufactured separately, the exit ports add a high degree of complexity to the designing and manufacturing of the polishing pad assemblies.

Accordingly, it is desirable to provide work piece polishing assemblies that provide for the efficient and passive removal of slurry from the surface of a polishing pad of a CMP apparatus. In addition, it is desirable to CMP apparatuses that utilize such work piece polishing assemblies. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

In accordance with an exemplary embodiment of the present invention, a work piece polishing assembly comprises a polishing pad comprising a polishing surface and an exhaust aperture that extends through the polishing pad from the polishing surface and is configured to receive a slurry from the polishing surface. An underlying member is disposed underlying the polishing pad and comprising a peripheral surface. The underlying member comprises a channel that is in fluid communication with the exhaust aperture and that opens at the peripheral surface of the underlying member.

In accordance with another exemplary embodiment of the present invention, a chemical mechanical planarization apparatus comprises a work piece carrier configured to hold a work piece horizontally and a polishing assembly. The polishing assembly comprises a polishing pad disposed parallel to the work piece and an underlying member underlying the polishing pad. The underlying member comprises a channel configured to receive a slurry from the polishing pad and to permit the slurry to be exhausted from a peripheral surface of the underlying member.

In accordance with a further exemplary embodiment of the present invention, a work piece polishing assembly comprises a polishing means for polishing a work piece during planarization using a slurry and an underlying member underlying the polishing means. The polishing means has an aperture that extends therethrough. The underlying means comprises a removal means for receiving slurry from the polishing means and permitting the slurry to be exhausted from a peripheral surface of the underlying member. The removal means comprises a portion that has a cross-sectional area perpendicular to the direction of slurry flow through the portion that is greater than a cross-sectional area of the aperture.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Figure 1:
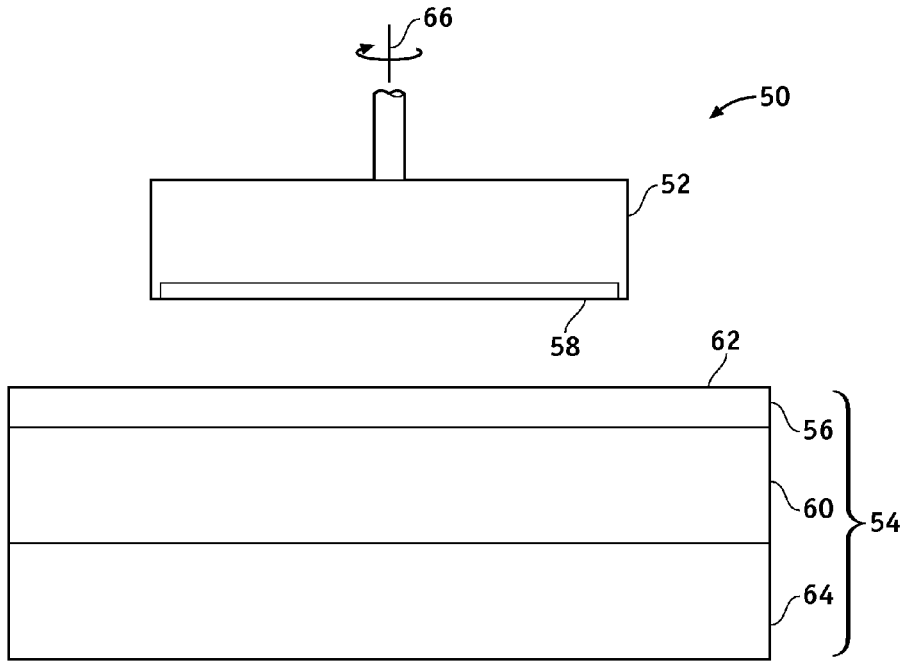
FIG. 1 is a side view of a chemical mechanical planarization apparatus that utilizes a work piece polishing assembly in accordance with an exemplary embodiment of the present invention.

FIG. 1 is a side view of a CMP apparatus 50 in accordance with an exemplary embodiment of the present invention. CMP apparatus comprises a work piece carrier 52 and a polishing assembly 54. The work piece carrier 52 holds in a substantially horizontal plane a work piece 58 during the process of polishing or planarizing the work piece. The work piece carrier 52 is configured to press the work piece against a polishing surface, described below, while relative motion between the work piece and the polishing surface is effected. In one embodiment, the wafer carrier 52 rotates work piece 58 about an axis 66. In another embodiment, wafer carrier 52 moves the work piece 58 linearly or orbitally relative to a polishing surface. Polishing assembly 54 comprises a horizontal polishing pad 56, the hardness and density of which depend on the material that is to be polished and the degree of precision required in the polishing process. Polishing pad 56 may be comprised of a top-pad configured to contact the surface of the work-piece as well as one or more sub-pads. The hardness and density of the top-pad and each sub-pad may differ from each other. Polishing pad 56 is supported by and attached to a platen 60, which in turn overlies a manifold assembly 64. Manifold assembly 64 may comprise one or more layers that are pressed together to form the assembly. Polishing assembly 54 is configured to rotate, orbit, and/or dither by a motor (not shown) that is coupled thereto.

During a polishing operation, the work piece 58 is pressed against a polishing surface 62 of the polishing pad 56 with a desired amount of "down force" such that the polishing surface 62 exerts a desired amount of pressure against the surface of the work piece. When the work piece 58 comprises a low dielectric constant material, it may be desirable to limit this pressure to a reduced pressure range, which typically includes the pressure range of from about 0.10 psi to about 3.0 psi. Relative lateral motion is induced between the carrier 52 and the polishing pad 56 to promote polishing. A slurry, which can be abrasive or non-abrasive, is applied to the polishing surface 62 of the polishing pad 56. Spent slurry then is passively removed from the polishing surface 62.

Figure 3:
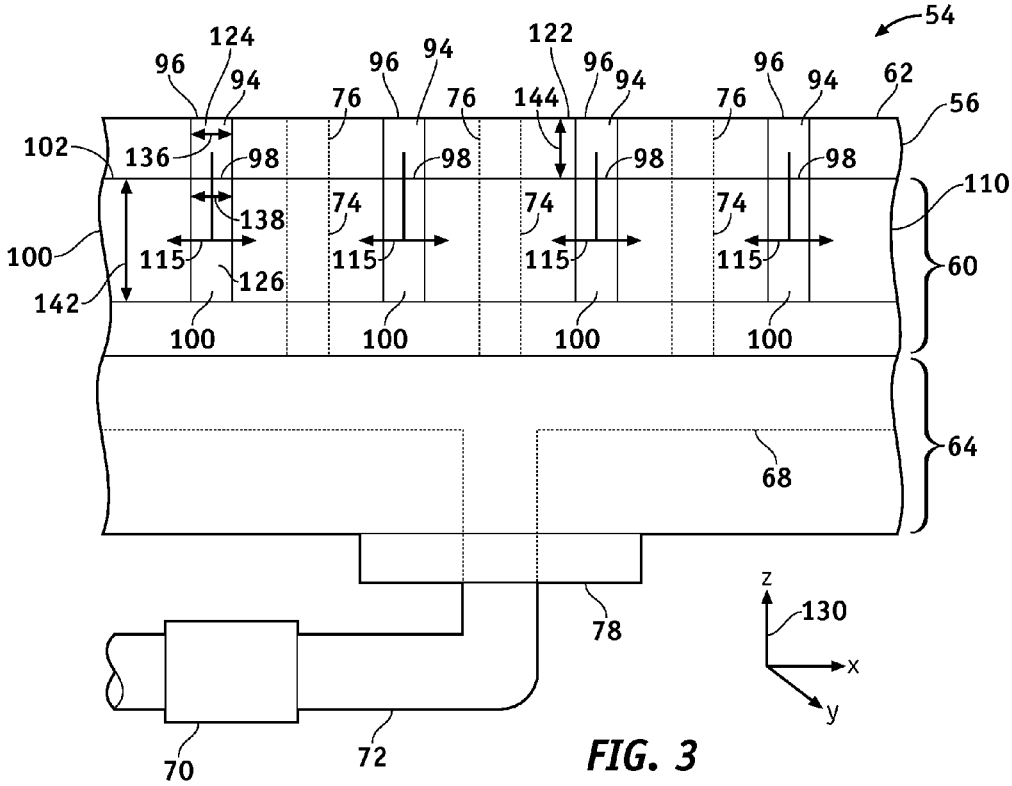
FIG. 3 is a cross-sectional view of the work piece polishing assembly of FIG. 2.
Figure 2:
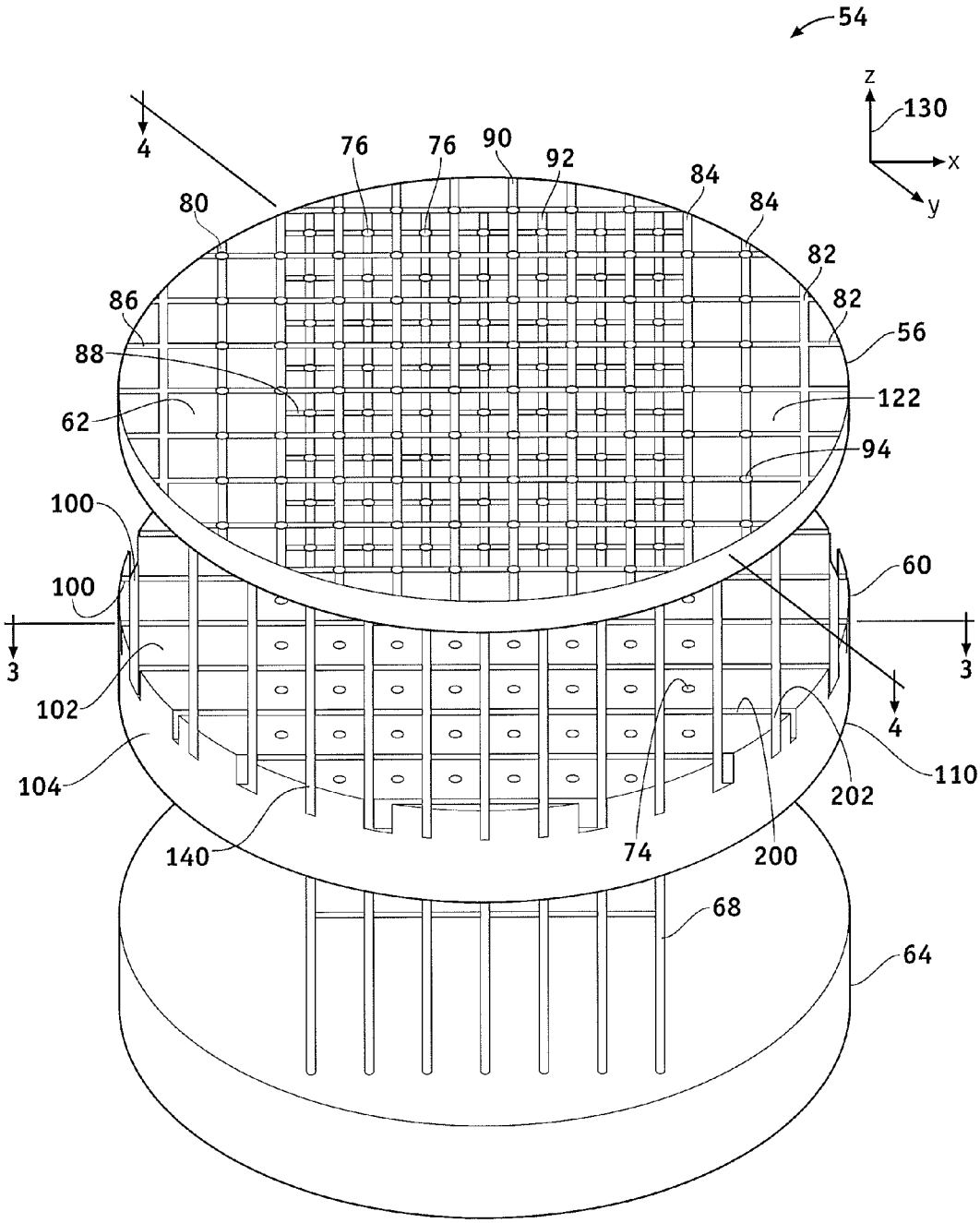
FIG. 2 is an exploded isometric view of the work piece polishing assembly of FIG. 1.

FIG. 2 is an exploded isometric view and FIG. 3 is a cross-sectional view of polishing assembly 54, in accordance with an exemplary embodiment of the invention, that delivers fresh polishing slurry to polishing surface 62 of polishing pad 56 and allows for the removal of spent slurry from the polishing pad via a peripheral surface of the polishing assembly. Polishing assembly 54 comprises a distribution manifold 68 disposed within the manifold assembly 64. A pump 70 forces the slurry through a fluid line 72 and through distribution manifold 68 to one or more supply conduits 74 formed within platen 60. The slurry then may suitably flow from supply conduits 74 through one or more supply holes 76 within polishing pad 56. Polishing assembly 54 is connected to a drive assembly 78 that is operative to move polishing assembly 54 in an orbital pattern. Alternatively, it will be appreciated that the drive assembly 78 may be operative to move polishing assembly 54 in a rotary, linear or oscillatory pattern or any combination of orbital, linear, oscillatory, and rotary patterns.

As illustrated in FIG. 3, polishing pad 56 has one or more grooves 80 that permit the slurry to flow from supply holes 76 over the polishing surface 62. The grooves 80 may be molded into the polishing pad 56 when originally fabricated or may be machined into the pad after fabrication. In one exemplary embodiment, relative to a coordinate system 130, the grooves may run in the "x" and "y" directions to form a grid with parallel x-direction grooves 82 and crossing perpendicular y-direction grooves 84. In another exemplary embodiment, x-direction grooves 80 may comprise major x-direction grooves 86 and minor x-direction grooves 88 and y-direction grooves 84 may comprise major y-direction grooves 90 and minor y-direction grooves 92. The major grooves have a larger cross-sectional area perpendicular to the direction of slurry flow than the minor grooves. The area perpendicular to the direction of slurry flow is defined as the width of the groove 80 or 84 in the x- or y-direction, respectively, multiplied by the depth of the groove in the z-direction. Minor x-direction grooves 88 and minor y-direction grooves 92 intersect at supply holes 76, causing slurry to flow from supply holes 76 to major grooves 86 and 90. The minor grooves 88 and 92 and the major grooves 86 and 90 assist in the distribution of the slurry across polishing pad 56 during planarization. While polishing pad 56 is illustrated with minor grooves and major grooves in a perpendicular relationship, it will be appreciated that grooves 80 can be of any cross-sectional size and can be configured in any suitable pattern that is configured to facilitate distribution of slurry. For example, polishing pad 56 may comprise only major grooves or may comprise only minor grooves. Alternatively, polishing pad 56 may comprise grooves of a uniform cross-sectional area that are in a hexagonal or other pattern.

Referring again to FIGS. 2 and 3, in addition to supply holes 76 for delivery of the slurry to the polishing surface 62, polishing pad 56 also comprises one or more exhaust apertures 94 through which spent slurry may flow away from polishing surface 62. Exhaust apertures 94 have an inlet end 96 through which spent slurry enters at polishing surface 62 and an exit end 98. The apertures 94 are in fluid communication with channels of an underlying member 110 of the polishing assembly, such as, for example, a polishing sub-pad (not shown), or the manifold apparatus. In one exemplary embodiment, the underlying member 110 is platen 60, which comprises one or more channels 100 that extend horizontally through platen 60. In one embodiment, channels 100 are disposed and open at a surface 102 of platen 60, as illustrated. In another embodiment, channels 100 are disposed wholly within platen 60 and are in fluid communication with exhaust apertures 94 via conduits (not shown) within the platen. The exit end 98 of each exhaust aperture 94 opens to one of the channels 100. The channels have at least one end 140 that extends to a peripheral surface 104 of platen 60. As used herein, the term "peripheral surface" refers to an outer surface of a structure that is substantially perpendicular to a horizontal surface of the structure. In one exemplary embodiment, the channels 100 have a cross-sectional area 126 perpendicular to the direction of flow that is greater than a cross sectional area 124 of the exhaust apertures 94. In this embodiment, the term "cross-sectional area 126" of channels 100 is the cross-sectional area of the channels 100 that is perpendicular to the direction of slurry flow and is defined as a width 138 of the channel 100 that is perpendicular to the direction of flow, multiplied by the depth 142 of the channel in the z-direction. As illustrated in FIG. 2, channels 100 may comprise channels 200 that extend in the x-direction and perpendicular channels 202 that extend in the y-direction. Thus, the cross-sectional area 126 of channels 200 is defined as a width of the channel in the y-direction multiplied by the depth 142 of the channel in the z-direction. Similarly, the cross-sectional area 126 of channels 202 is defined as a width of the channel in the x-direction multiplied by the depth 142 of the channel in the z-direction. In the vertical exhaust apertures 94, the term "cross-sectional area 124" of the exhaust apertures 94 is the cross-sectional area perpendicular to the direction of slurry flow and is defined as a width 136 in the x-direction multiplied by the width (not shown) in the y-direction. In this regard, because the channels open to atmospheric pressure at the peripheral surface of the platen, and because the channels have a cross-sectional area 126 that is greater than the cross-sectional area 124 of the exhaust apertures, the spent slurry within the exhaust apertures and the channels is at atmospheric pressure so that the slurry flows passively from the polishing surface 62 of polishing pad 56 through exhaust apertures 94, as illustrated by arrows 115, and is exhausted at the peripheral surface 104 of the platen. Accordingly, there is minimal or no backup of the slurry in the channels 100 or exhaust apertures 94 that may increase the likelihood of hydroplaning of the work piece on the polishing surface 62. In addition, because the channels 100 are not in the polishing pad 56, exhaust flow of the slurry is not affected by wear of the polishing pad.

In one exemplary embodiment of the invention, the channels 100 are not uniform in size, cross-sectional area or pattern. For example, the cross-sectional areas 126 of the channels may be greater near the periphery of the platen than at the center. In another embodiment, the cross-sectional area of the channels may vary based on the location of the exhaust apertures with which they are in fluid communication, as described in more detail below. In yet another example, the channels do not lie in an x-y perpendicular pattern but, rather, lie in any other pattern that permits exhausting of the spent slurry to the periphery of the platen.

In one exemplary embodiment of the present invention, the channels 100 are disposed underlying the grooves 80 of polishing pad 56 and the pattern of the channels 100 mimics at least a portion of the pattern of the grooves 80 in the polishing pad 56. In this regard, regions of the polishing pad that contact the work piece ("land areas") 122 are fully supported by the platen 60 so that the polishing pad 56 maintains sufficient contact with the work piece during planarization. In an exemplary embodiment, the width 138 of the channels is substantially equal to the width 136 of apertures 94 so that the "land areas" 122 of the polishing pad are fully supported by platen 60. In another exemplary embodiment of the invention, the width 138 of the channels is greater than the width 136 of exhaust apertures 94.

Figure 4:
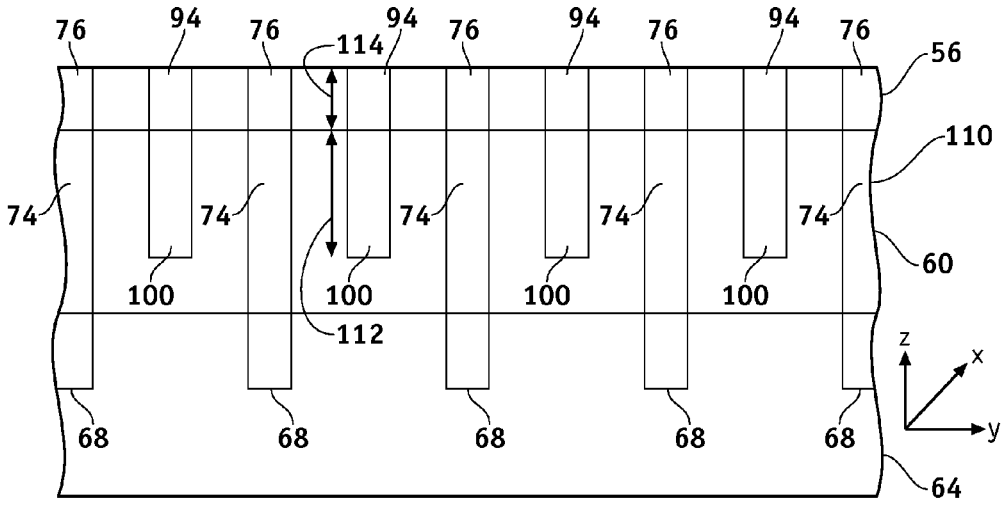
FIG. 4 is a cross-sectional view of the work piece polishing assembly of FIG. 3 taken along the 4-4 plane.

Referring to FIG. 4, in one embodiment of the invention, polishing pad 56 has a plurality of supply holes 76 and a plurality of exhaust apertures 94, with at least one exhaust aperture disposed proximate to a supply hole 76. For example, in an exemplary embodiment of the present invention for the polishing of 300 mm work pieces, an exhaust aperture 94 is within about 0.25 inches to about 1 inch of a supply hole 76. In another exemplary embodiment, an exhaust aperture 94 is within 0.5 to about 0.7 inches of a supply hole 76. However, it will be appreciated that the exhaust apertures 94 can be any suitable distance from the supply holes 76 so that the configuration of supply holes and exhaust apertures minimizes the residence time of the spent slurry at the polishing surface 62. As fresh slurry flows from the supply holes 76 to the polishing surface 62, it reacts with the work piece surface. Because the exhaust apertures 94 are close to the supply holes 76, the spent slurry can immediately drain from the polishing surface 62 so that spent slurry does not significantly dilute fresh slurry across the polishing surface.

Figure 5:
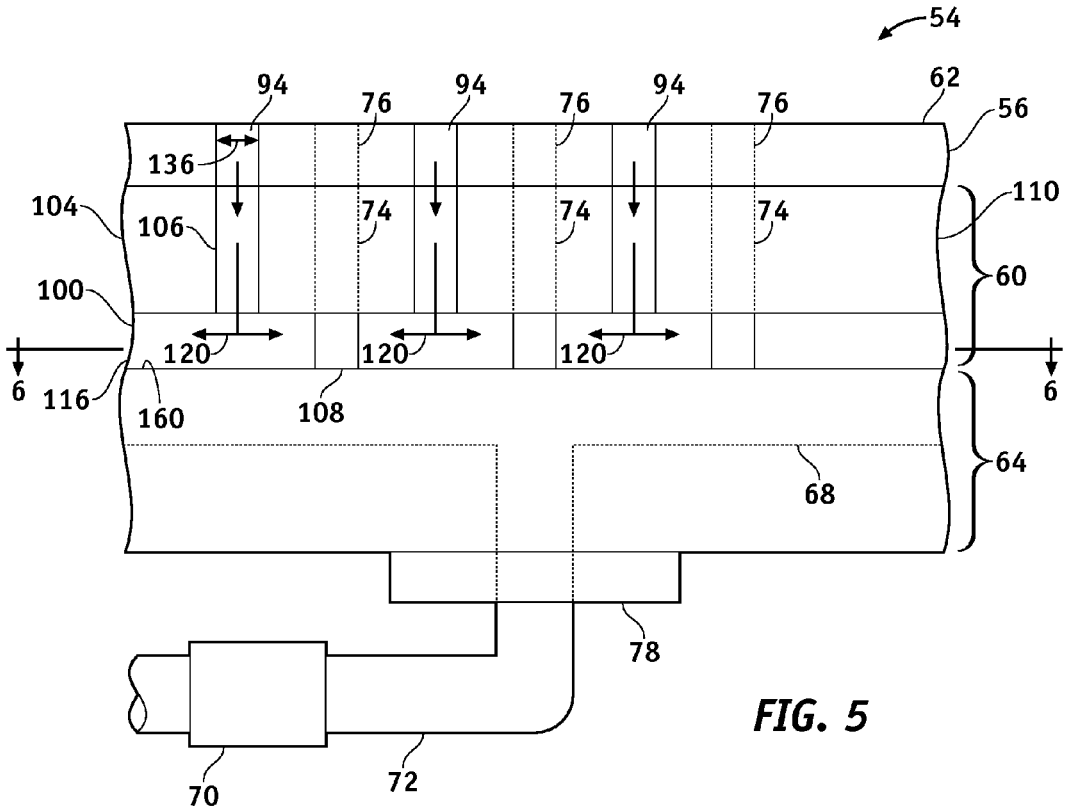
FIG. 5 is a cross-sectional view of a work piece polishing assembly in accordance with an exemplary embodiment of the present invention.
Figure 6:
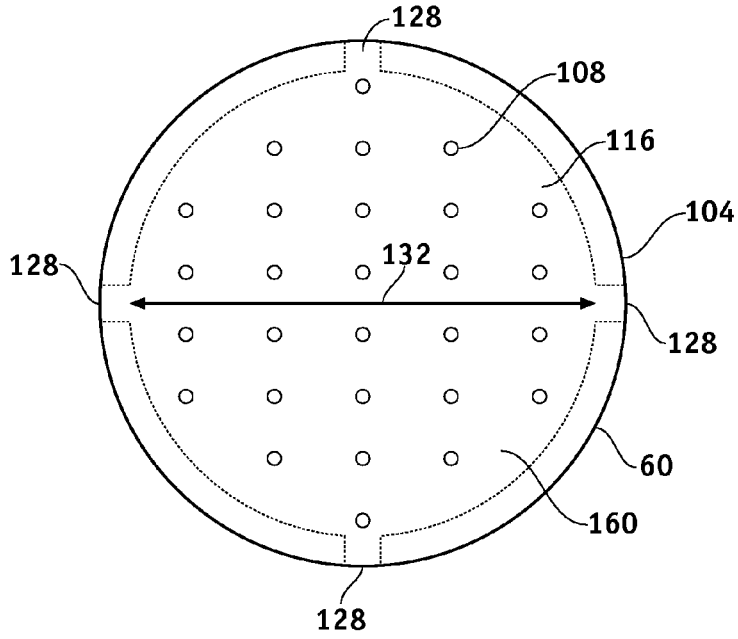
FIG. 6 is a top view of the work piece polishing assembly of FIG. 5 taken along the 6-6 plane.

Referring to FIGS. 5 and 6, in accordance with another exemplary embodiment of the present invention, one or more channels 100 are disposed wholly within platen 60 and are configured as one or more reservoirs 116 that have a width, indicated by double-headed arrow 132, that is greater than width 136 of the exhaust apertures 94 of polishing pad 56. The reservoir 116 has at least one end 128 that is open to the peripheral surface 104 of platen 60. In one embodiment, due to the width of reservoir 116, one or more supply tubes 108 extend from a surface 160 of platen 60 through the reservoir 116 to supply conduits 74 within platen 60, which are in axial alignment and fluid communication with supply tubes 108. Supply tubes 108 may be formed of flexible material, such as a polymer, or a rigid material, such as a thermoset polymer, a ceramic, or a metal. Exhaust apertures 94 are coupled to the reservoir(s) 116 via exhaust conduits 106 that extend through a portion of platen 60. Accordingly, during the planarization process, spent slurry can flow from the polishing surface 62 through exhaust apertures 94 and exhaust conduits 106 to reservoir(s) 116, where it flows horizontally, as illustrated by arrows 120, under atmospheric pressure, around supply tubes 108 to exhaust at peripheral surface 104 of platen 60.

Figure 7:
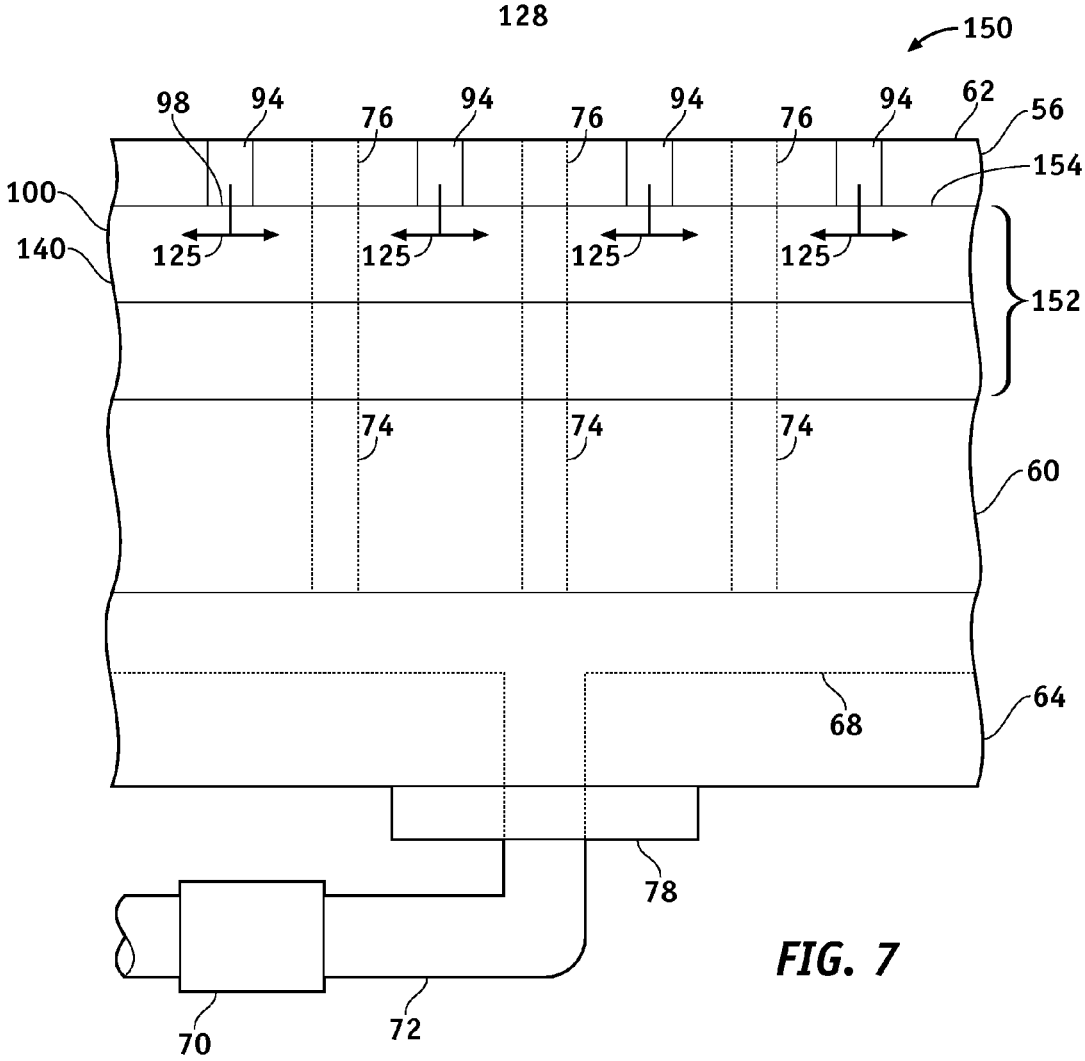
FIG. 7 is a cross-sectional view of a work piece polishing assembly in accordance with an exemplary embodiment of the present invention.

As noted above, the underlying member 110 of a polishing assembly also can be a polishing sub-pad. Referring to FIG. 7, a polishing assembly 150 in accordance with another exemplary embodiment of the present invention comprises polishing top-pad 56 having supply holes 76 and exhaust apertures 94, platen 60 having supply conduits 74, and manifold assembly 64 disposed thereunder. A polishing sub-pad 152 is interposed between the top-pad 56 and the platen 60. Polishing sub-pad 152 may comprise a polishing pad backing layer, an insulating layer, a diaphragm, or the like. Polishing sub-pad 152 may comprise one or more channels 100 disposed horizontally on a surface 154 of polishing sub-pad 152 or within polishing sub-pad 152. The exit end 98 of each exhaust aperture 94 opens to one of the channels 100. The channels have at least one end 140 that extends to the peripheral surface 104 of polishing sub-pad 152. As described above, in one exemplary embodiment, the channels 100 have a cross-sectional area 126 that is greater than a cross sectional area 124 of the apertures 94. Accordingly, because the channels open to atmospheric pressure at the peripheral surface of the polishing sub-pad, and because the channels have a cross-sectional area that is greater than the cross-sectional area of the exhaust apertures, the spent slurry within the apertures and the channels is at atmospheric pressure so that the slurry flows passively from the polishing surface 62 of top-pad 56 through exhaust apertures 94 and then flows horizontally, as illustrated by arrows 125, to be exhausted at the peripheral surface 104 of the polishing sub-pad.

It will be appreciated that, while the above embodiments describe a CMP apparatus with a polishing assembly that is configured for the supply delivery of slurry through the polishing assembly via a distribution manifold, any other suitable means can be used to deliver the slurry to the polishing surface 62 of the polishing pad 56. For example, the slurry can be deposited directly onto the polishing surface 62 of the polishing pad. Accordingly, during planarization, the slurry will be distributed across the polishing pad by the motion of the work piece and the polishing assembly and, if present, via grooves 80. The slurry can then be passively removed from polishing surface 62 through exhaust apertures 94 and channels 100.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A work piece polishing assembly comprising:

a polishing pad comprising a polishing surface, an exhaust aperture that extends through the polishing pad from the polishing surface and is configured to receive a slurry from the polishing surface, and a groove disposed and extending along the polishing surface; and an underlying member disposed underlying the polishing pad and comprising a peripheral surface, wherein the underlying member comprises a channel that is in fluid communication with the exhaust aperture and that opens at the peripheral surface of the underlying member, and wherein the channel underlies the groove, and a pattern of the channel mimics at least a portion of the pattern of the groove;

wherein the polishing pad comprises a supply hole and the underlying member comprises a supply conduit that is in fluid communication with the supply hole, and wherein the supply hole and the supply conduit are configured to receive the slurry and permit the slurry to flow to the polishing surface of the polishing pad.

2. The work piece polishing assembly of claim 1, wherein the channel comprises a cross-sectional area that is greater than a cross-sectional area of the exhaust aperture, and wherein the cross-sectional area of the channel is perpendicular to a flow of the slurry through the channel and the cross-sectional area of the exhaust aperture is perpendicular to the flow of the slurry through the exhaust aperture.

3. The work piece polishing assembly of claim 1, wherein the groove is in fluid communication with the exhaust aperture.

4. The work piece polishing assembly of claim 3, wherein a width of the channel is approximately equal to a width of the exhaust aperture or the groove.

5. The work piece polishing assembly of claim 1, wherein the channel is disposed at a horizontal surface of the underlying member.

6. The work piece polishing assembly of claim 1, wherein the channel is configured as a reservoir comprising a width that is greater than a width of the exhaust aperture and that comprises at least one end that opens at the peripheral surface of the underlying member.

7. The work piece polishing assembly of claim 1, wherein the underlying member is a platen, a polishing sub-pad, or a manifold assembly.

8. The work piece polishing assembly of claim 1, wherein the exhaust aperture is proximate to the supply hole.

9. A chemical mechanical planarization apparatus comprising:

a work piece carrier configured to hold a work piece horizontally; and a polishing assembly comprising:

a polishing pad disposed parallel to the work piece and comprising an exhaust aperture, a polishing surface, and a groove disposed and extending along the polishing surface and in fluid communication with the exhaust aperture, wherein the polishing pad further comprises a supply hole configured to receive fresh slurry and permit the fresh slurry to flow to the polishing surface of the polishing pad and wherein the exhaust aperture is proximate to the supply hole; and an underlying member underlying the polishing pad and comprising a channel configured to receive a slurry from the exhaust aperture and to permit the slurry to be exhausted from a peripheral surface of the underlying member, wherein the channel underlies the groove, and a pattern of the channel mimics at least a portion of a pattern of the groove.

10. The chemical mechanical planarization apparatus of claim 9, wherein the channel has a cross-sectional area perpendicular to a direction of slurry flow within the channel that is greater than a cross-sectional area of the exhaust aperture, wherein the cross-sectional area of the exhaust aperture is perpendicular to a direction of slurry flow in the exhaust aperture.

11. The chemical mechanical planarization apparatus of claim 10, wherein the channel has a width that is substantially equal to a width of the exhaust aperture.

12. The chemical mechanical planarization apparatus of claim 9, wherein the underlying member is a platen, a sub-polishing pad, or a manifold assembly.

13. The chemical mechanical planarization apparatus of claim 9, wherein the channel is disposed at a horizontal surface of the underlying member.

14. A work piece polishing assembly comprising:

a polishing means for polishing a work piece during planarization using a slurry, wherein the polishing means has an exhaust aperture that extends therethrough, a polishing surface, and a groove in fluid communication with the exhaust aperture and disposed and extending along the polishing surface; and an underlying member underlying the polishing means and comprising a channel for receiving slurry from the polishing means and permitting the slurry to be exhausted from a peripheral surface of the underlying member, wherein the channel comprises a portion that has a cross-sectional area perpendicular to a direction of slurry flow through the portion that is greater than a cross-sectional area of the exhaust aperture, and wherein the channel has a pattern that mimics a pattern of the groove.

15. The work piece polishing assembly of claim 14, wherein the underlying member comprises a platen, wherein the platen further comprises exhaust conduits disposed within the platen and a reservoir in fluid communication with the exhaust conduits, wherein the reservoir comprises at least one end at the peripheral surface, and wherein the reservoir has a cross-sectional area that is greater than a cross-sectional area of the exhaust aperture.

* * * * *